US007467789B2

(12) United States Patent
Murata et al.

(10) Patent No.: US 7,467,789 B2
(45) Date of Patent: Dec. 23, 2008

(54) SHEET HANDLING APPARATUS AND IMAGE FORMING APPARATUS

(75) Inventors: Mitsushige Murata, Chiba (JP); Hiromichi Tsujino, Ibaraki (JP); Yuzo Matsumoto, Ibaraki (JP); Takako Hanada, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/834,229

(22) Filed: Aug. 6, 2007

(65) Prior Publication Data

US 2007/0284809 A1 Dec. 13, 2007

Related U.S. Application Data

(63) Continuation of application No. 10/784,258, filed on Feb. 24, 2004, now Pat. No. 7,281,708.

(30) Foreign Application Priority Data

Feb. 27, 2003 (JP) ..... 2003-050794
Feb. 28, 2003 (JP) ..... 2003-054417

(51) Int. Cl.
*B65H 37/04* (2006.01)

(52) U.S. Cl. ..... 270/58.12; 270/58.08; 270/58.09; 270/58.11; 270/58.17; 270/58.27

(58) Field of Classification Search ..... 270/58.1, 270/58.08, 58.09, 58.11, 58.12, 58.17, 58.27
See application file for complete search history.

(56) References Cited

U.S. PATENT DOCUMENTS 4,582,312 A * 4/1986 Abrams et al. ..... 270/1.03
5,449,157 A * 9/1995 Kawano et al. ..... 270/58.11
5,535,012 A 7/1996 Matsumoto et al. ..... 358/400
5,580,045 A 12/1996 Matsumoto et al. ..... 271/298
5,590,871 A * 1/1997 Okabe et al. ..... 270/58.27
5,741,009 A 4/1998 Kawano et al. ..... 271/182
5,761,600 A 6/1998 Murata ..... 399/403
6,021,305 A 2/2000 Sato et al. ..... 399/374
6,120,020 A 9/2000 Asao ..... 271/189
6,219,503 B1 4/2001 Miyake et al. ..... 399/85
6,246,491 B1 6/2001 Matsumoto et al. ..... 358/468
6,330,422 B1 12/2001 Sato et al. ..... 399/382
6,353,726 B1 3/2002 Murata et al. ..... 399/407
6,371,472 B1 4/2002 Miyake et al. ..... 270/58.14
6,471,429 B1 10/2002 Isobe et al. ..... 400/582

(Continued)

FOREIGN PATENT DOCUMENTS

JP 2001-26355 1/2001

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

When the rear end of a sheet bundle S is brought to reach the clamping portion between a rocking roller and a rear end aligning wall by conveyance means, the individual timings, at which the rocking roller and the rear end aligning wall move to the escape position, are controlled to drop said sheet bundle S onto a stack tray, and then the rear end aligning wall is moved from the escape position to the support position thereby to register the rear end of the sheet bundle S dropped on the stack tray.

5 Claims, 12 Drawing Sheets

U.S. PATENT DOCUMENTS 6,493,113 B1 12/2002 Fujii et al. ..... 358/488
6,603,951 B2 8/2003 Sato et al. ..... 399/382
2003/0214090 A1 11/2003 Kato et al. ..... 270/12
2006/0220293 A1* 10/2006 Kaneko ..... 270/58.08

* cited by examiner

FIF.4B

SHEET HANDLING APPARATUS AND IMAGE FORMING APPARATUS

This application is a continuation of U.S. patent application Ser. No. 10/784,258, filed Feb. 24, 2004, and allowed Jul. 10, 2007.

BACKGROUND OF THE INVENTION

1. Field of the Invention

The present invention relates to a sheet handling apparatus capable of handling and stacking sheets, and an image forming apparatus provided with the sheet handling apparatus.

2. Description of the Related Art

A sheet handling apparatus of the related art is described with reference to FIG. 11. FIG. 11 is a sectional view showing the entire construction of an image forming apparatus provided with the sheet handling apparatus of the related art.

In the image forming apparatus of the related art such as a printer, a copying machine or a printer machine, as shown in FIG. 11, sheets S having images formed in an image forming apparatus body 1200 are temporarily stacked on a handling tray 1540 in a sheet handling apparatus 1500, in which the sheets S are subjected to a post-handling such as to a aligning operation or a stapling operation.

After this, the sheet bundle is discharged by bundle discharge means 1580 to a stack tray 1581 having a sloped stack face, as shown in FIG. 11. Then, the discharged sheets S move on the sloped stack face of the stack tray 1581 by their own weights and are aligned at their rear ends on a rear end aligning wall. The number of stacked sheets depends on the vertical running stroke of the stack tray 1581.

SUMMARY OF THE INVENTION

The present invention has further developed from the related art described above, and has an object to provide a sheet handling apparatus capable stacking a plurality of sheets sequentially in a aligned state, and an image forming apparatus provided with the sheet handling apparatus.

Another object of the invention is to provide a sheet handling apparatus capable of preventing a sheet bundle from becoming loose on stack means, and an image forming apparatus provided with the sheet handling apparatus.

Still another object of the invention is to provide a sheet handling apparatus for realizing an improvement in the productivity of the sheet handling, and an image forming apparatus provided with the sheet handling apparatus.

In order to achieve the above-specified objects, according to the invention, there is provided a sheet handling apparatus comprising:

stack means for stacking a sheet or a sheet bundle;

support means capable of moving selectively to a support position at which it supports the lower face of the sheet or the sheet bundle, or an escape position at which it escapes from the lower face of the sheet or the sheet bundle;

change-over control means for changing the support position and the escape position of the support means; and conveyance means capable of conveying the sheet or the sheet bundle supported by the support means to the stack means, wherein, when the rear end of the sheet or the sheet bundle is brought to reach the upper portion of the support means by the conveyance means, the change-over control means moves the support means to the escape position at a first moving velocity thereby to drop the sheet or the sheet bundle onto the stack means, and then moves the support means at such a second moving velocity from the escape position to the support position as is specified such that the support means pushes the sheet or the sheet bundle so as to align the rear end of the sheet or the sheet bundle dropped on the stack means, and wherein the second moving velocity is slower than the first moving velocity.

According to the construction described above, the time period till the sheet handling ends can be shortened, with the load being kept as in the related art, by setting the moving velocity of the support means at the escape time higher than that at the aligning time, thereby to improve the productivity.

According to the invention, there is also provided a sheet handling apparatus comprising:

stack means for stacking a sheet or a sheet bundle;

first support means capable of moving selectively to a support position, at which it supports the upper face of the sheet or the sheet bundle, or an escape position at which it escapes from the upper face of the sheet or the sheet bundle;

second support means capable of moving selectively to a support position, at which it supports the lower face of the sheet or the sheet bundle, or an escape position at which it escapes from the lower face of the sheet or the sheet bundle;

change-over control means for changing the support position and the escape position individually independently of the first support means and the second support means; and conveyance means capable of conveying the sheet or the sheet bundle supported by the first support means and the second support means to the stack means, wherein, when the rear end of the sheet or the sheet bundle is brought to reach the clamping portion between the first support means and the second support means by the conveyance means, the change-over control means controls the individual timings, at which the first support means and the second support means move to the escape position, thereby to drop the sheet or the sheet bundle onto the stack means, and then moves the second support means from the escape position to the support position thereby to align the rear end of the sheet or the sheet bundle dropped on the stack means.

According to the construction described above, the sheet bundle is vertically clamped between the first support member and the second support member, and the timings for moving the support members to the escape position to release the clamped state are individually controlled, so that the sheet bundle can be prevented from becoming loose when it drops to the stack means, thereby to improve the stack quality of the sheet bundle on the stack means. As a result, the thickness of the sheet bundle can be precisely decided to prevent the sheets from being stacked over a permissible number thereby to prevent the sheets in advance from dropping from the stack means.

It is preferable that the change-over control means controls the timing, at which the first support means moves to the escape position, simultaneously with or earlier than the timing, at which the second support means moves to the escape position.

According to the construction described above, even if the clamping state is released while the sheet bundle being curved, the first support means for supporting the upper face of the sheet bundle escapes to release the force applied to the sheet bundle, so that the sheet bundle can be prevented from becoming loose when it drops onto the stack means. As a result, the stackability of the sheet bundle on the stack means is improved.

It is preferable that the second support member has a lower elastic force in the supporting state than that of the first support member in the supporting state.

On the other hand, an image forming apparatus according to the invention comprises:

the sheet handling apparatus; and image forming means for forming an image on the sheets to be conveyed to the sheet handling apparatus.

BRIEF DESCRIPTION OF THE DRAWINGS

FIGS. 4A, 4B and 4C are sectional views showing the actions of a rocking roller of the sheet handling apparatus according to the embodiment;

DETAILED DESCRIPTION OF THE PREFERRED EMBODIMENTS

Preferred embodiments of the invention will be illustratively described in detail with reference to the accompanying drawings. However, the sizes, materials, shapes, relative arrangements, and so on of the components to be described in the embodiments should not be construed to limit the scope of the invention to those components, unless otherwise specified.

The embodiments of a sheet handling apparatus according to the embodiment and an image forming apparatus provided with the sheet handling apparatus will be specifically described with reference to the accompanying drawings.

(Entire Construction)

Figure 1:
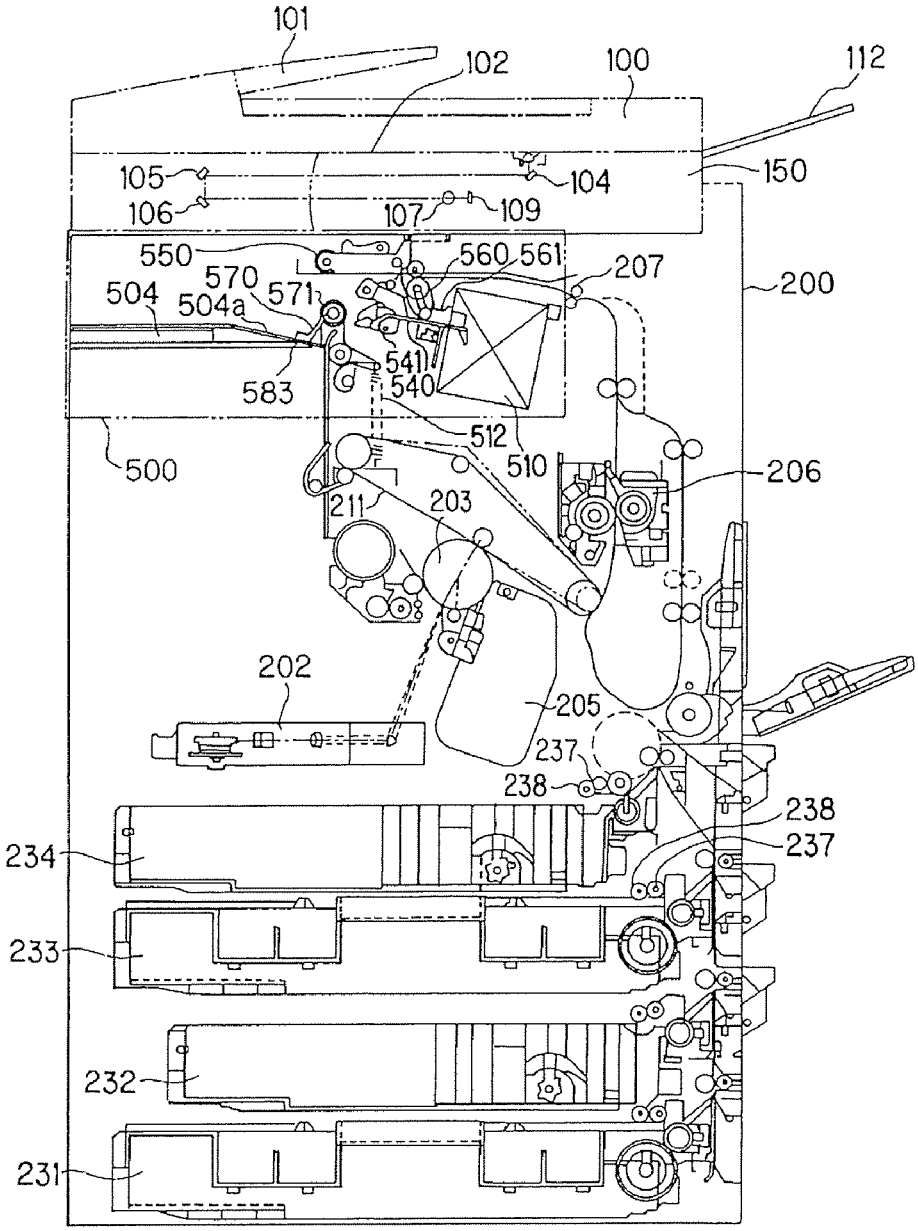
FIG. 1 is a sectional view showing the entire construction of an image forming apparatus provided with a sheet handling apparatus according to an embodiment.
Figure 2:
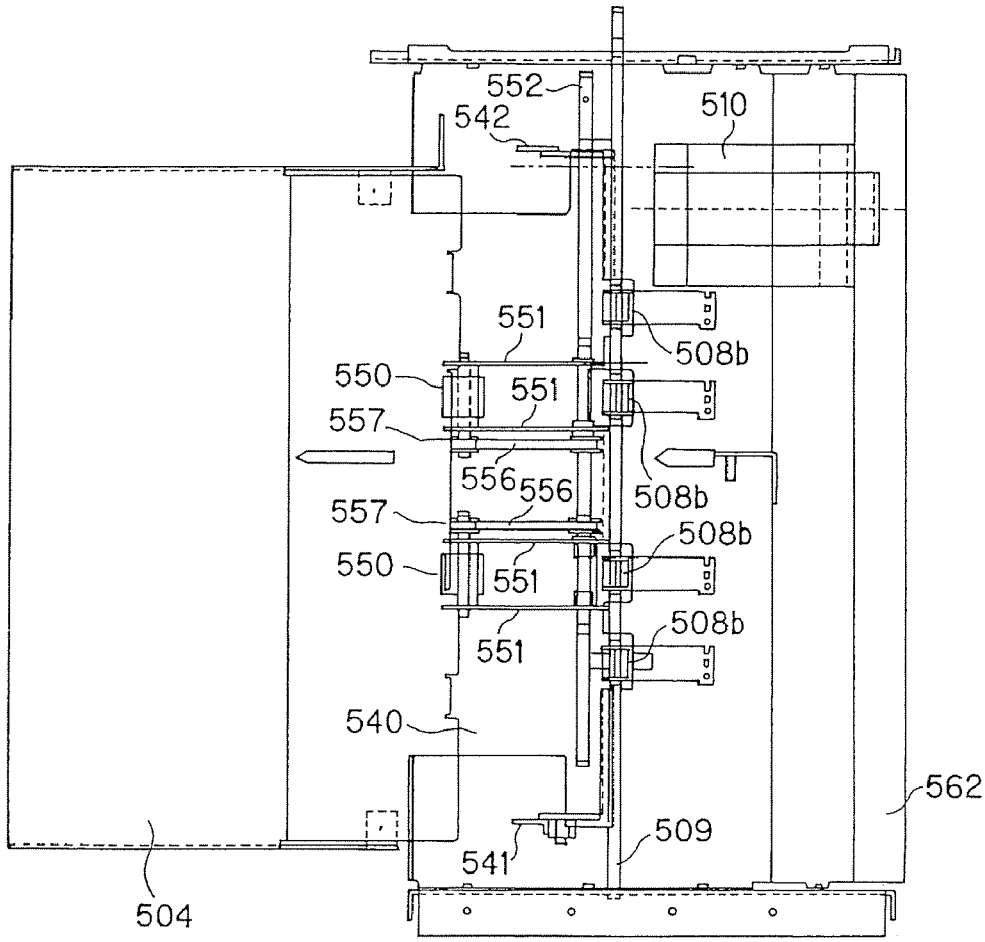
FIG. 2 is a top plan view of the sheet handling apparatus according to the embodiment.
Figure 3:
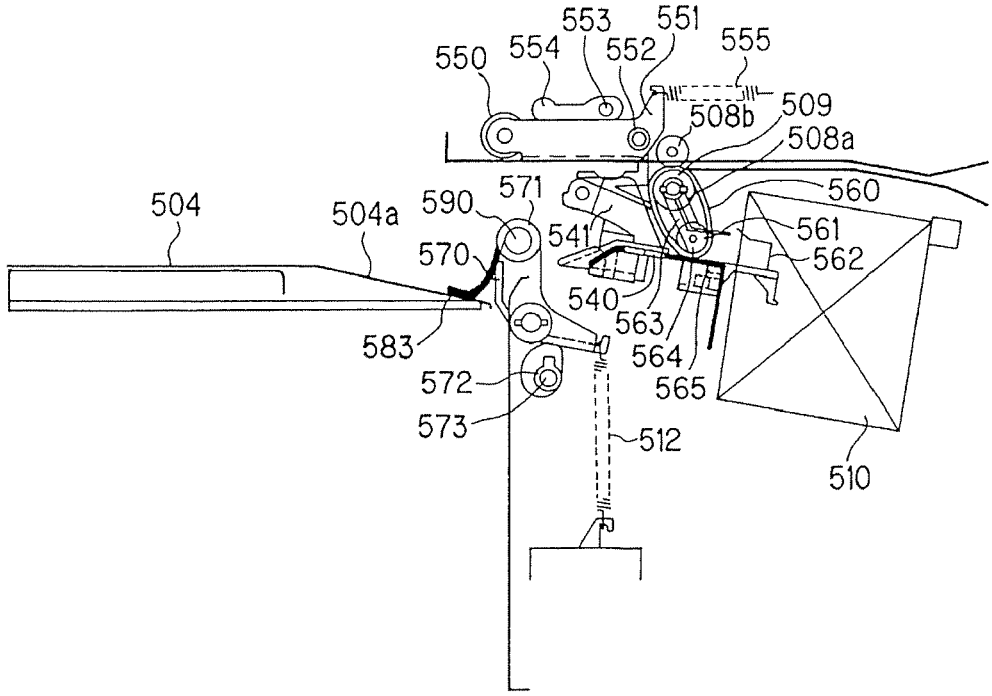
FIG. 3 is a sectional view showing the schematic construction of the sheet handling apparatus according to the embodiment.

FIG. 1 is a sectional view showing the entire construction of an image forming apparatus body provided with a sheet handling apparatus according to an embodiment; FIG. 2 is a top plan view of the sheet handling apparatus according to the embodiment; and FIG. 3 is a sectional view showing the schematic construction of the sheet handling apparatus according to the embodiment.

As shown in FIG. 1, the sheet handling apparatus 500 is arranged in the upper portion of the image forming apparatus body 200 and below a document reading device 100. The sheet handling apparatus 500 stacks image-formed sheets S discharged from the image forming apparatus body 200, temporarily on a handling tray 540, and subjects them to a post handling treatment such as stapling or aligning treatment. After this, the handled sheets S are aligned and stacked on a stack tray 504, which is arranged substantially horizontally. The invention will be described in connection with the sheet handling apparatus 500.

However, the invention is also effective either for the construction, in which a sheet stacking and aligning device for aligning and stacking the image-formed sheets S discharged from the image forming apparatus body 200 on the stack tray 504 is connected not through the handling tray 540 but directly to the image forming apparatus body 200, or for the construction, in which the sheet handling apparatus 500 is disposed outside of the image forming apparatus body 200.

In FIG. 1, the sheet handling apparatus 500 is mounted in the image forming apparatus body 200. On the other hand, the automatic document reading device 100 is disposed over the image forming apparatus body 200. The image forming apparatus body 200, the sheet handling apparatus 500 and the automatic document reading device 100 construct the image forming apparatus, but the sheet handling apparatus 500 may not be provided with the handling tray 540.

On the image forming apparatus body 200, as shown in FIG. 1, there is mounted a document reading unit 150, on which is mounted the document reading device 100. This document reading device 100: separates the upward set documents upward; feeds the documents leftward one by one sequentially from the leading page; conveys the document onto a platen glass 102 through a curved path; and reads and then discharges the document to a discharge tray 112.

In the automatic document reading device 100, the document is read by irradiating it with the light of the lamp of a scanner unit 104 and by guiding the light reflected from the document into an image sensor 109 through mirrors 105 and 106 and a lens 107. The image of the document read by the image sensor 109 is subjected to an image treatment and is sent to an exposure control unit 202 of the image forming apparatus body 200, and a laser beam is emitted.

Next, in the exposure control unit 202, that laser beam is reflected by a turning polygon mirror and is reflected back again by a reflecting mirror so that it irradiates a photosensitive drum 203 having a homogeneously charged surface to act as image forming means thereby to form an electrostatic latent image. This electrostatic latent image on the photosensitive drum 203 is developed by a developer 205 and is transferred as a toner image onto the sheet S made of paper, an OHP sheet or the like.

The sheets S are: let suitably and selectively off sheet cassettes 231, 232, 233 and 234 by a pickup roller 238 constructing sheet feed means; separated by separation means 237 and fed one by one; corrected from oblique positions by a pre-registration roller pair; and then sent to a transfer position in synchronism with of the rotation of the photosensitive drum 203 so that the toner image formed on the photosensitive drum 203 is transferred to the sheets S through a transfer belt 211.

After this, the sheet S is guided into a fixing roller pair 206 and subjected to heating and pressing treatments by the fixing roller pair 206 so that the toner image transferred to the sheet S is permanently fixed. With these paired fixing rollers 206, respectively, there contact a fixing upper separating pawl and a fixing lower separating pawl, by which the sheet S is separated from the fixing roller pair 206.

The separated sheet S is conveyed by a body side discharge roller pair 207 to the outside of the image forming apparatus body 200 so that it is guided into the sheet handling apparatus 500 connected to the image forming apparatus body 200.

(Sheet Handling Apparatus Construction)

The construction of the sheet handling apparatus 500 will be specifically described in the following.

In FIG. 1, the sheet handling apparatus 500 is provided with the handling tray 540 arranged on the upstream side to act as sheet stacking means, and the stack tray 504 arranged substantially horizontally on the downstream side. The sheet S discharged from the body side discharge roller pair 207 of the image forming apparatus body 200 is post-handled by the handling tray 540 and are stacked on the stack tray 504.

The post-handling mode to be done in the handling tray 540 includes a sort mode for sorting a plurality of sheet bundles, and a stapling mode for stapling a plurality of sheets with a staple unit 510, and is selected and set by the not-shown setting means before the job is started.

Here in the stapling mode, the stapling position can be selected between a one stapling position and two stapling positions, and the staple unit 510 moves to the actual stapling position in accordance with the set contents such as the sheet size or the stapling position.

As shown in FIG. 2 and FIG. 3, the sheet S discharged from the image forming apparatus body 200 is further discharged toward the stack tray 504 by the discharge unit, which is composed of a discharge roller 508*a* on the side of the sheet handling apparatus 500 and a discharge roller 508*b* following the former. The rear end of the sheet S is dropped, at the timing to have passed through the discharge unit, onto the handling tray 540 by a rocking roller 550 so that it is clamped between the rocking roller 550 and a driven roller 571.

(Rocking Roller Construction)

Figure 4A:
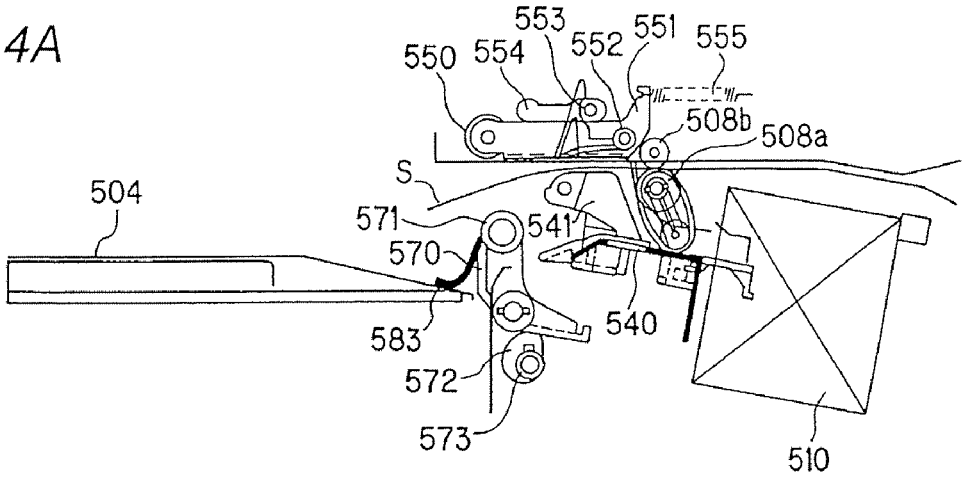
Figure 4A:
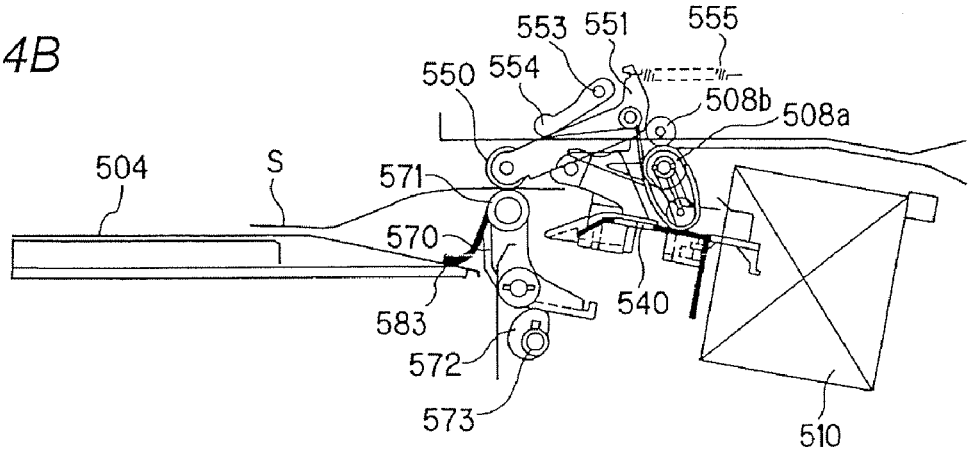
Figure 4C:
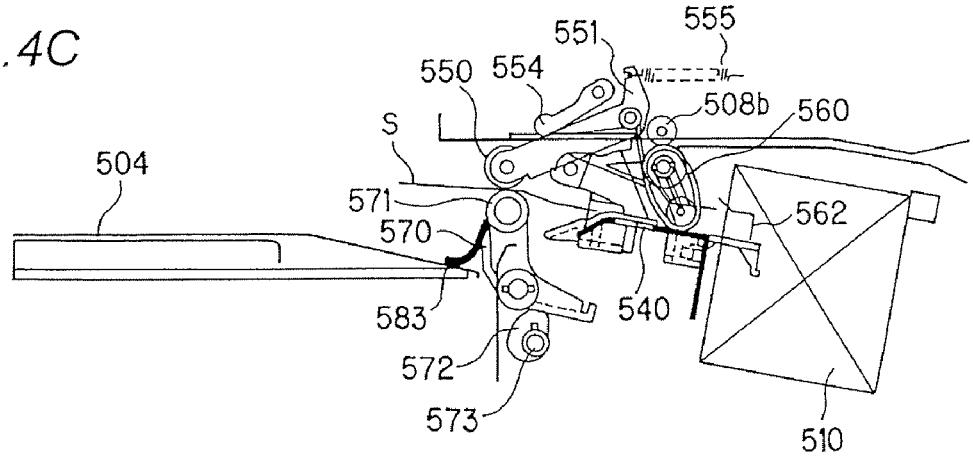
Figure 8:
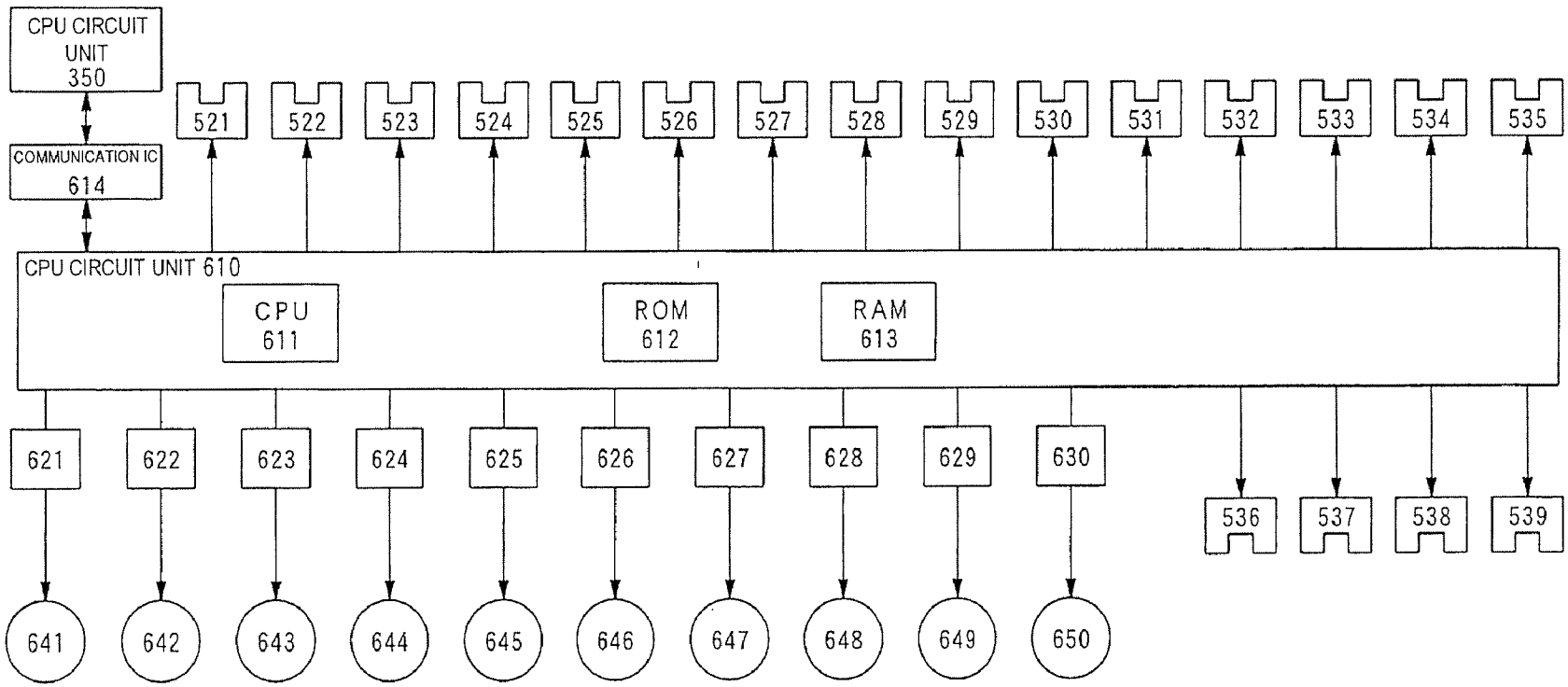
FIG. 8 is a block diagram illustrating a control unit of the sheet handling apparatus according to the embodiment.

The actions of a rocking arm 551 and the rocking roller 550 will be described with reference to FIG. 2, FIGS. 4A, 4B and 4C and FIG. 8. FIGS. 4A, 4B and 4C are sectional views showing the actions of the rocking roller of the sheet handling apparatus according to the embodiment, and FIG. 8 is a block diagram illustrating a control unit of the sheet handling apparatus according to the embodiment.

As shown in FIGS. 4A to 4C, the rocking roller 550 is attached to the rocking arm 551, which can rock in the vertical directions by taking a rocking roller shaft 552 as a center.

To the rocking arm shaft 553 of the rocking arm 551, there is transmitted the drive from a rocking arm drive motor 643 through a rocking cam 554, so that the rocking arm 551 rocks in the vertical directions together with the rocking cam 554 by taking the rocking roller shaft as a center when the rocking arm drive motor 643 rotates.

To the rocking arm 551, on the other hand, there is mounted a rocking arm tension spring 555 for aiding the upward rocking motion.

The rocking roller 550 is connected to the rocking roller shaft 552 through a rocking roller drive belt 556 and a rocking roller driven pulley 557. The rocking roller 550 is connected to a rocking roller drive motor 642, so that the rocking roller 550 rotates when a drive signal is transmitted from a CPU 611 shown in FIG. 8 through a rocking roller drive motor driver 622 to the rocking roller drive motor 642.

(Rocking Roller Actions)

The actions of the rocking roller 550 will be described in detail with reference to FIGS. 4A to 4C.

The home position of the rocking roller 550 is located at an upper portion, which is kept away from abutment against the sheet S discharged onto the handling tray 540 by the discharge unit (FIG. 4A).

When the sheet S is discharged from the discharge unit, the rocking arm 551 is turned counter-clockwise on the rocking roller shaft 552 by the drive of the rocking arm drive motor 643. As a result, the rocking roller 550 descends to push the rear end of the sheet S thereby to drop the sheet rear end portion into the handling tray 540 (FIG. 4B).

The rocking roller 550 forms a nip together with the driven roller 571 and rotates counter-clockwise with the drive of the rocking roller drive motor 642 thereby to pull the sheet S along a lower guide 561 backward of the transfer direction till then until the rear end of the sheet S on the handling tray 540 comes into abutment against a return belt 560 (FIG. 4C).

After this, the rocking roller 550 ascends again to the home position and prepares itself for the discharge of the next sheet S (FIG. 4A).

(Return Belt Actions)

Figure 5A:
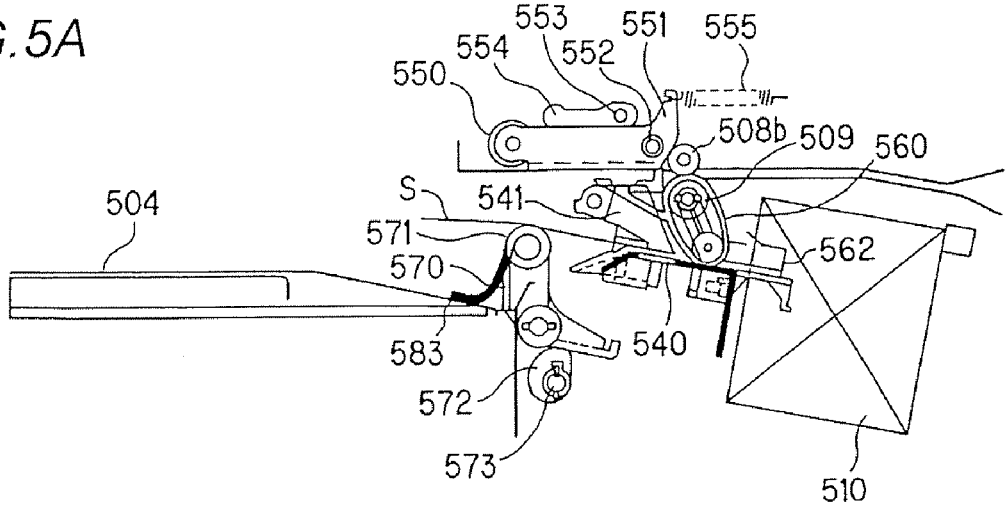
FIGS. 5A and 5B are sectional views showing the actions of a return belt of the sheet handling apparatus according to the embodiment.
Figure 5B:
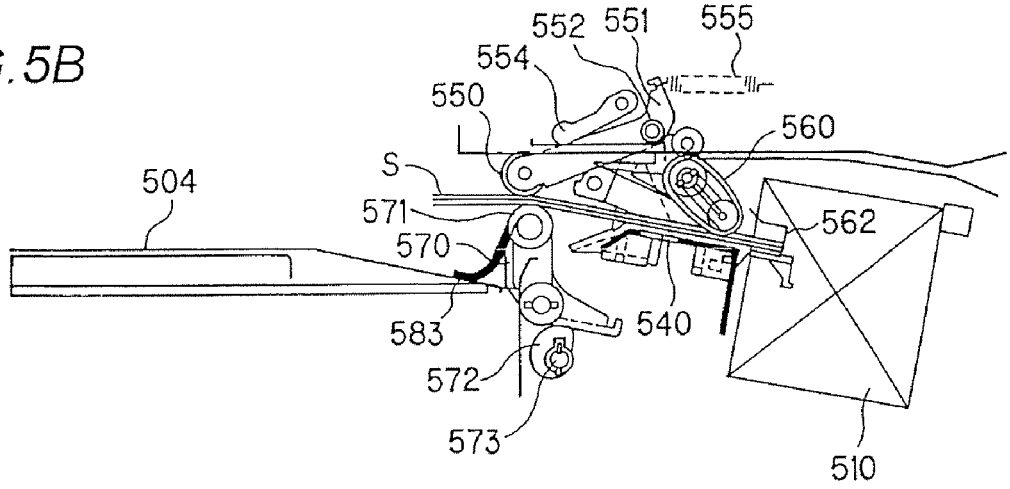

Next, the actions of the return belt 560 will be described with reference to FIG. 3 and FIGS. 5A and 5B. FIGS. 5A and 5B are sectional views showing the actions of the return belt of the sheet handling apparatus according to the embodiment.

The return belt 560 is vertically supported by the discharge roller shaft 509 and is usually set at a portion to contact with the sheet S on the handling tray 540.

The return belt 560 is composed of at least one sheet feed rotor, which is arranged perpendicularly of the direction, in which the sheet S abuts against a sheet rear end stopper 562. The return belt 560 is constructed such that a belt 565 is made to run on the discharge roller 508*a* and a return belt pulley 564 supported by a housing 563 (as referred to FIG. 3). The return belt 560 causes, when the discharge roller shaft 509 rotates counter-clockwise, the belt 565 to convey the sheet S toward the sheet rear end stopper 562 (FIG. 5A).

Moreover, the return belt 560 escapes in the thickness direction of the sheets S stacked on the handling tray 540, in accordance with the number of sheets (FIG. 5B).

Thus, by the counter-clockwise turns of the rocking roller 550 and the return belt 560, the rear ends of the sheets S are positioned at the end portion of the handling tray 540 and are conveyed to the sheet rear end stopper 562 of the sheet S acting as sheet accepting means for accepting the sheets S on the handling tray 540 so that the sheets S are aligned one by one in the sheet conveyance direction.

(Sheet Widthwise Alignment)

The alignment in the sheet widthwise direction will be described with reference to FIG. 2 and FIG. 8.

A front aligning plate 541 and a rear aligning plate 542 are driven to move in parallel with the discharge roller shaft 509 by a front aligning motor 646 and a rear aligning motor 647.

While the sheet handling apparatus 500 is inactive, the front aligning plate 541 and the rear aligning plate 542 are on standby at positions to detect the not-shown front aligning home position sensor 530 and rear aligning home position sensor 531, respectively. These positions are called the "aligning home positions", which are set to prevent the sheets being conveyed from abutting against the front aligning plate 541 and the rear aligning plate 542.

The front aligning plate 541 and the rear aligning plate 542 move to the standby positions according to the size of the sheets S before the sheets S are conveyed from the image forming apparatus body 200. After the sheets S were aligned in the conveyance direction, as described above, the front aligning plate 541 and the rear aligning plate 542 move to the aligning positions which were set in the post-handling mode before the job start, so that the sheets S are aligned in their widthwise direction.

In case the sort mode is selected, for example, when the N-th sheet is to be aligned in the widthwise direction, the front aligning plate 541 is on standby at a reference position, and performs the alignment with respect to the front side, when the rear aligning plate 542 moves from the standby position to the sheet aligning position, so that the sheet is discharged to the stack tray 504 by the actions to be described hereinafter.

When the (N+1)-th sheet is to be aligned, the rear aligning plate 542 is on standby at the reference position, and performs the aligning with respect to the rear side, when the front aligning plate 541 moves from the standby position to the sheet aligning position, so that the sheet is discharged to the stack tray 504.

As a result, the sheets can be so stacked on the stack tray 504 that they are sorted each time the bundle is discharged.

It is naturally possible to align the sheets with reference to their center position. In this case, both the front aligning plate 541 and the rear aligning plate 542 move for the alignment from the standby position to the aligning position referring to the center position.

In case the stapling mode is selected, the aforementioned widthwise aligning actions are performed at the position according to the set stapling position.

In case the stapling mode is selected, the widthwise aligning actions are accompanied by the stapling actions. The staple unit 510 is caused to perform the stapling actions by the drive of a staple clinch motor 648. On the other hand, the staple unit 510 is enabled to move in the longitudinal directions by the drive of a staple slide motor 649.

When the job is started, the staple unit 510 moves to the actual stapling position, which is indexed from the contents of the stapling position set before the job start and from the sheet size.

The staple unit 510 performs the stapling actions on the aligned sheet bundle S having finished the aforementioned widthwise alignment.

(Bundle Discharge Means)

Figure 6A:
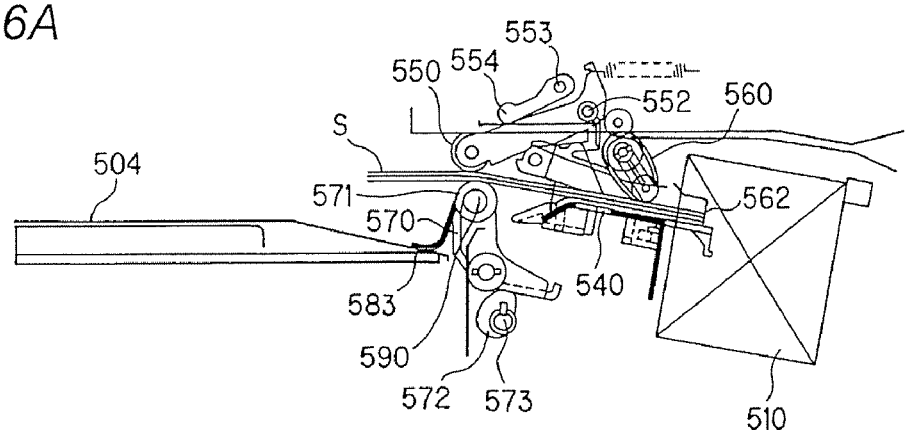
FIGS. 6A, 6B and 6C are sectional views showing a sheet bundle discharging actions of the sheet handling apparatus according to the embodiment.
Figure 6B:
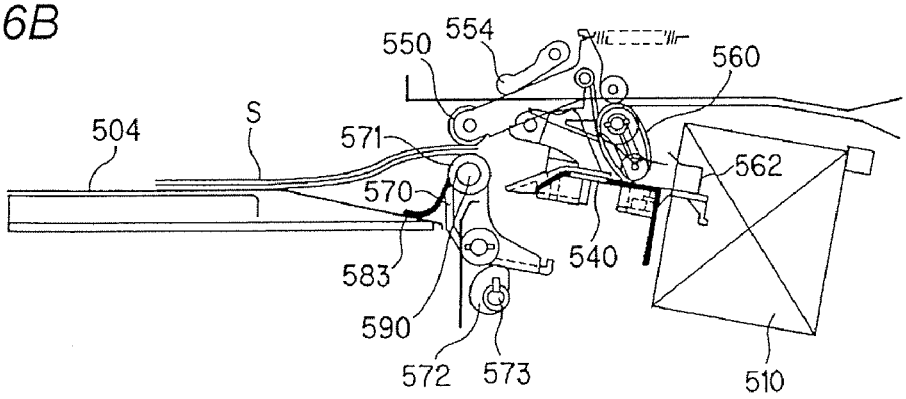
Figure 6C:
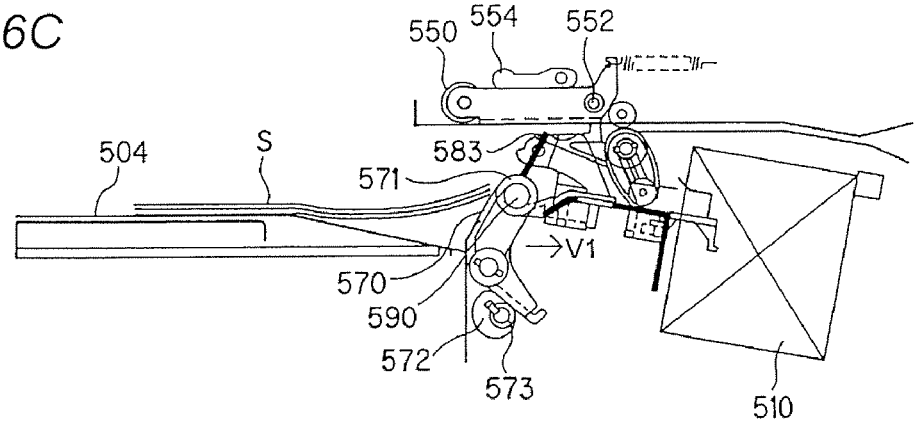

Next, the bundle discharge means will be described with reference to FIGS. 6A, 6B and 6C and FIG. 8. FIGS. 6A, 6B and 6C are sectional views showing the sheet bundle discharging actions of the sheet handling apparatus according to the embodiment.

After the ends of the alignment in the sheet conveyance direction, the alignment in the sheet widthwise direction and the stapling actions, the rocking roller 550 descends on the rocking roller shaft 552 with the drive of the rocking arm drive motor 643 till it abuts against the sheet bundle S (FIG. 6A), thereby to form a nip with the driven roller 571, which is arranged at the upper end of a rear end aligning wall 570. After this, the rocking roller 550 rotates clockwise to convey the sheet bundle S till this rear end reaches the vicinity of the upper end of the rear end aligning wall 570, and to stop the sheet bundle S (FIG. 6B).

After this, the rocking roller 550 leaves the sheet bundle S and returns to the home position (FIG. 6C). Substantially simultaneously with this, the rear end aligning wall 570 is rocked on a cam rocking shaft 573 at a moving velocity V1 in the direction opposite to the sheet transfer direction by a cam 572, which is located below the rear end aligning wall 570.

Figure 11:
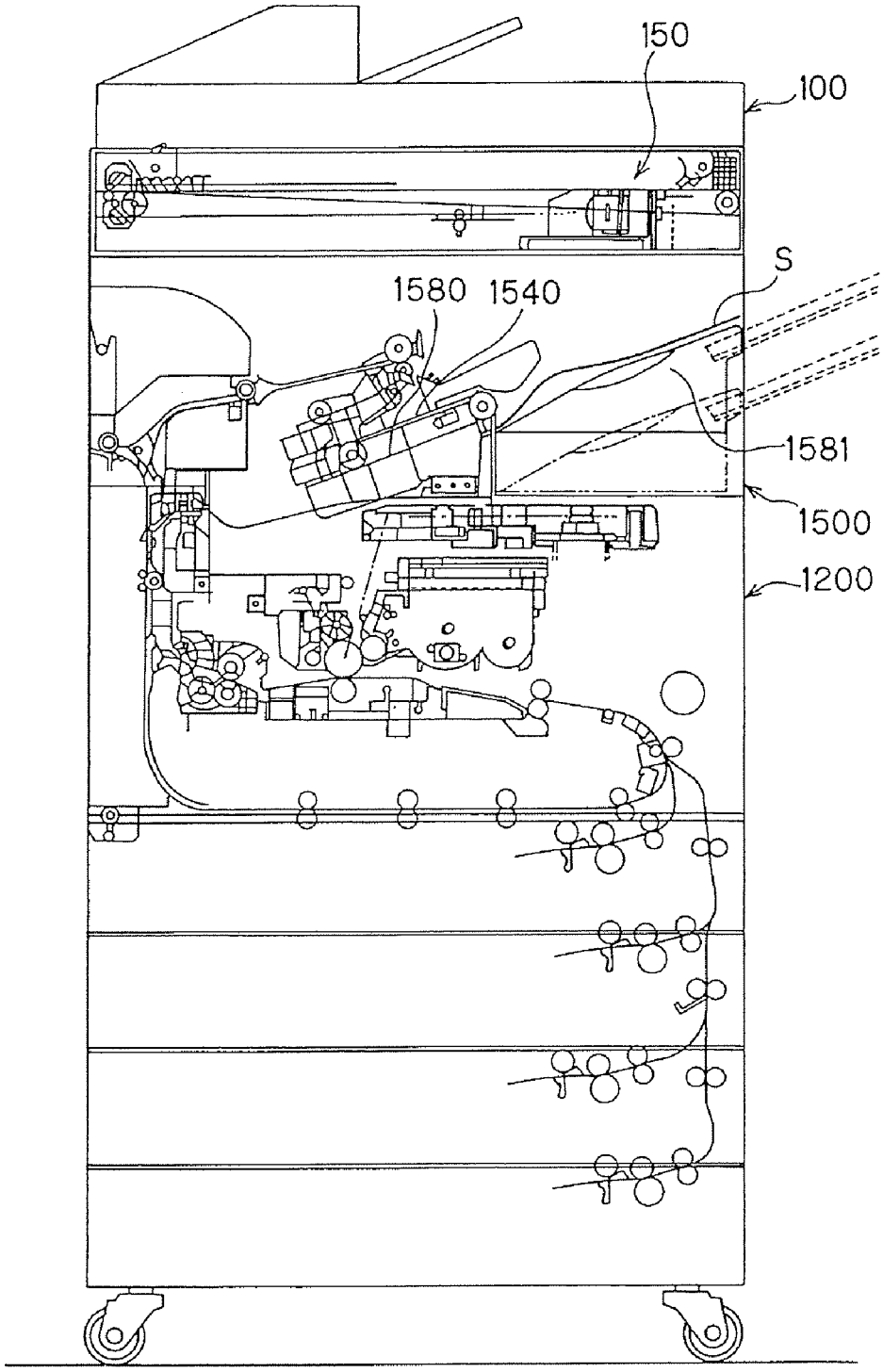
FIG. 11 is a sectional view showing the entire construction of an image forming apparatus provided with the sheet handling apparatus of the related art.
Figure 12A:
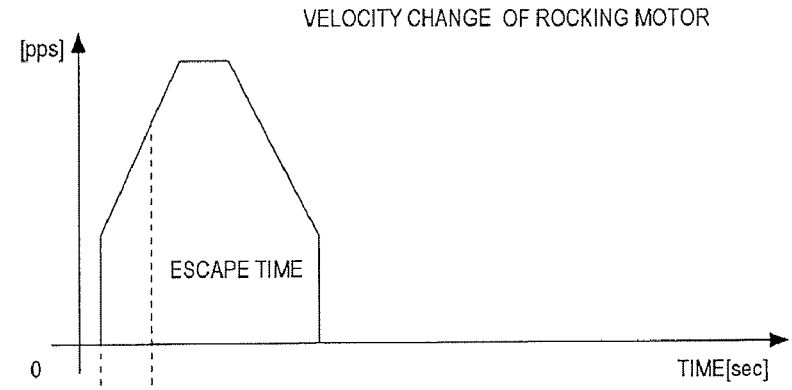
FIG. 12 is a time chart illustrating a transition of a clamping pressure after a bundle discharge.
Figure 12B:
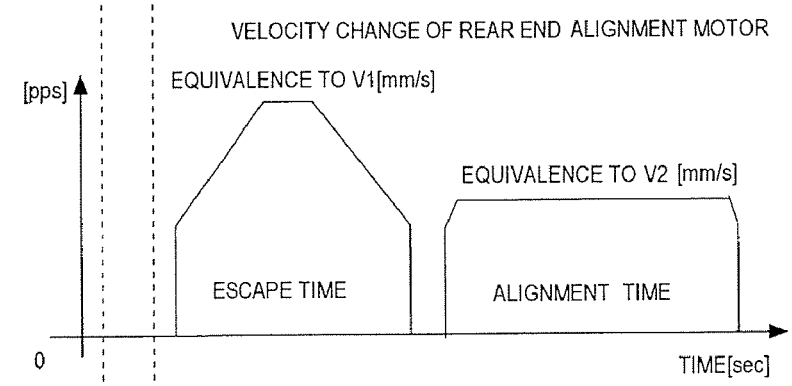
Figure 12C:
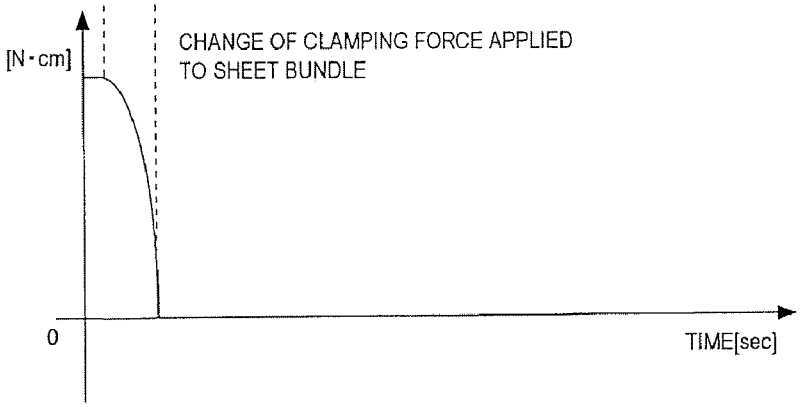

In case the handling time is sufficient, moreover, the rear end aligning wall 570 may be started to move at a timing, as shown in FIG. 11, after the rocking roller 550 left the sheet bundle S so that the nip pressure (or the clamping pressure) was released (to the clamping pressure 0). Simultaneously or before the sheet bundle is released from the clamped state while being curved, the rocking roller 550 supporting the upper face of the sheet bundle escapes to release the force being applied to the sheet bundle. Therefore, the sheet bundle can be prevented from becoming loose when it drops onto the stack means, thereby to improve the stack quality of the sheet bundle on the stack means.

On the other hand, the elastic force of the driven roller 571 in the state, where the sheet bundle S is clamped between the rocking roller 550 and the driven roller 571, is desirably set to a lower level than that of the elastic force of the rocking roller 550. In other words, the modulus of elasticity of the driven roller 571 in the state, where the sheet bundle S is clamped between the rocking roller 550 and the driven roller 571, is desirably set to a lower level than that of the rocking roller 550. As a result, the sheet bundle weight is so reliably supported on the lower face of the sheet bundle as to cause no abrupt load change at the time of releasing the nip pressure, so that the sheet bundle can be kept in a satisfactory aligning state to improve the stack quality of the sheet bundle on the stack means.

(Sheet Rear End Alignment)

Figure 7A:
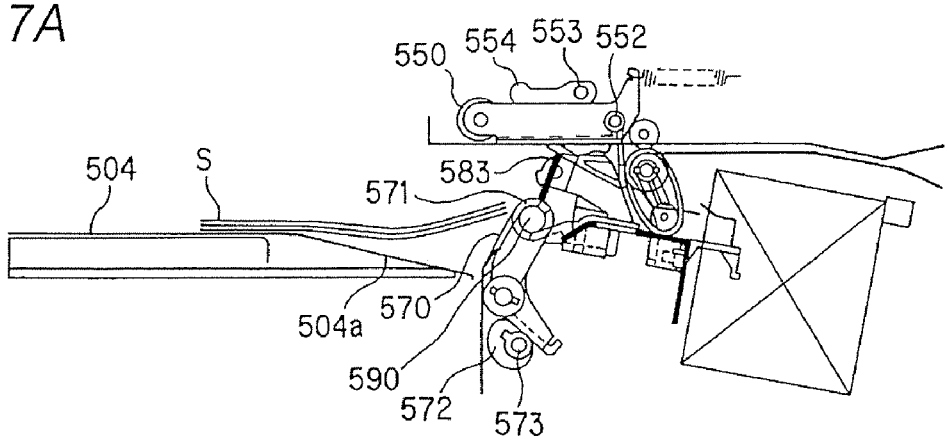
FIGS. 7A, 7B and 7C are sectional views showing a sheet bundle rear end aligning actions of the sheet handling apparatus according to the embodiment.
Figure 7B:
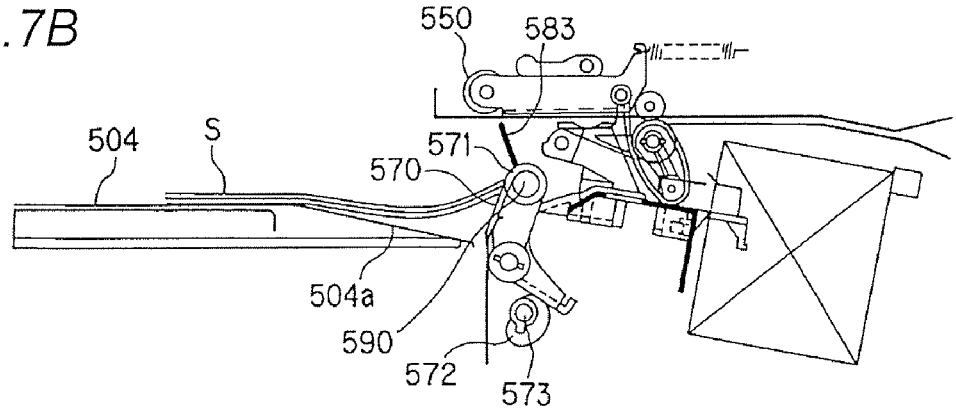
Figure 7C:
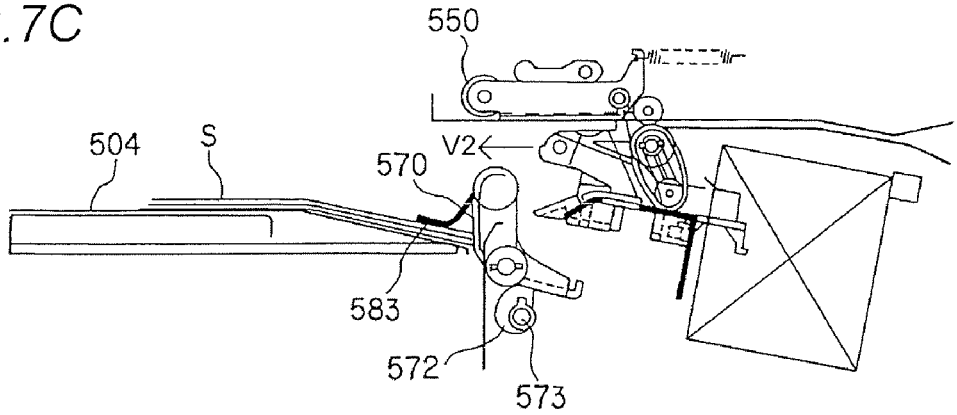
Figure 10:
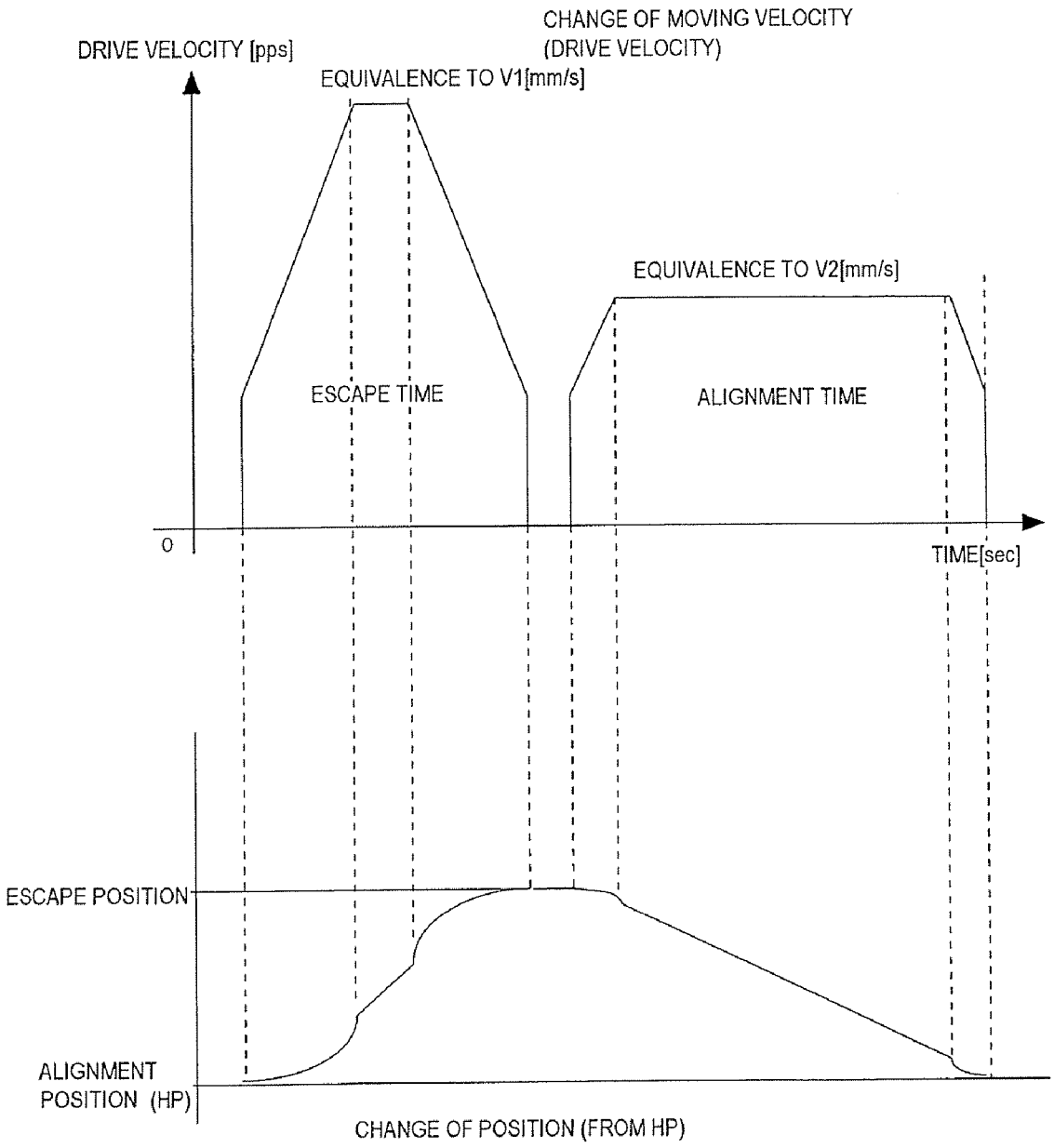
FIG. 10 is a time chart illustrating a drive state of a rear end aligning wall motor.

The means for discharging the sheet bundle S on the handling tray 540 onto the stack tray 504 and for aligning and stacking the sheet bundle will be described with reference to FIGS. 7A, 7B and 7C and FIG. 10. FIGS. 7A, 7B and 7C are sectional views showing the sheet bundle rear end aligning actions of the sheet handling apparatus according to the embodiment, and FIG. 10 is a graph plotting relations between the moving velocity (or the drive velocity) and the position in connection with the drive control of the rear end aligning wall motor according to the embodiment.

The rear end aligning wall 570 is biased by a spring 512 so that it is rocked on the cam rocking shaft 573 when it comes into abutment against the cam 572 at the home position (FIG. 3 and FIGS. 7A to 7C).

In the state where the rear end of the sheet bundle S discharged by the bundle discharge means abuts against the upper end of the rear end aligning wall 570 (FIG. 6B), the rear end aligning wall 570 is escaped at the moving velocity V1 to the upstream side in the sheet conveyance direction (FIG. 6C) thereby to bring the rear end of the sheet bundle S into abutment of the slope portion of the rear end aligning wall 570 (FIG. 7A). In order to enhance the precision of the sheet rear end alignment, the home position of the rear end aligning wall 570 is detected by a rear end aligning wall home position sensor 523 (FIG. 8).

In the procedure for returning the escaped rear end aligning wall 570 at a moving velocity V2 by taking the rocking rotation shaft as a center to the home position, the sheet bundle S is stacked on the stack tray 504 while aligning the rear end of the sheet bundle S by pushing the rear end of the sheet bundle S in the horizontal direction with the rear end aligning wall 570 (FIG. 7B and FIG. 7C). In case the moving velocity of the rear end aligning wall 570 to the home position is set to a higher velocity than the velocity V2, the sheet bundle S is energized as it is pushed at its rear end by the rear end aligning wall 570. Therefore, the sheet bundle S may slide, even after the rear end aligning wall 570 was stopped, on the stack tray 504 or on the uppermost sheet of the sheet bundle already stacked, until it is stopped in a disturbed aligning state. Still the worse, the sheet bundle S may stop in the range, which cannot be reached by the later-described sheet returning member 583. Therefore, the moving velocity V2 is set to the value, at which the rear end aligning wall 570 does not leave the rear end of the sheet bundle S but keeps the pushed state.

Here in the drive control of the rear end aligning wall motor according to the embodiment, as shown in FIG. 10, at first for the escape, the motor is activated to establish the moving velocity V1. When the movement ends, the rear end aligning motor is stopped. When a predetermined time elapses after the stop, the returning actions are started so that the rear end aligning motor is activated to establish the moving velocity V2. After this movement ends, the rear end aligning motor is stopped.

By setting the moving velocity V1 and the moving velocity V2 in a relation of V1>V2, moreover, the handling time period necessary for discharging the sheet bundle is shortened while keeping the aligning quality by the rear end aligning wall 570.

The sheet bundle stacked on the stack tray 504 is returned, after discharged, to the side of the rear end aligning wall 570 by the sheet returning member 583 and is held on its upper face.

The construction thus far described will be more specified in the following. The sheet handling apparatus 500 according to the invention comprises: the intermediate handling means (e.g., the staple unit 510) for stacking and handling the sheets S conveyed from the sheet conveyance means (e.g., the body side discharge roller pair 207); the stack means (e.g., the stack tray 504) for stacking the sheet bundle handled by the intermediate handling means; the first support means (e.g., the rocking roller 550) capable of moving selectively to the support position for supporting the upper face of the sheet bundle handled by the intermediate handling means or the escape position escaped from the upper face of the sheet bundle; the second support means (e.g., the rear end aligning wall 570 and the driven roller 571) capable of moving selectively to the support position for supporting the lower face of the sheet bundle handled by the intermediate handling means or the escape position escaped from the lower face of the sheet bundle; the change-over control means for changing the support position and the escape position individually independently of the first support means and the second support means; and the conveyance means capable of conveying the sheet bundle supported by the first support means and the second support means to the stack means. When the rear end of the sheet bundle is brought by the conveyance means to reach the clamping portion between the first support means and the second support means, the change-over control means controls the individual timings, at which the first support means and the second support means move to the escape positions, to drop the sheet bundle onto the stack means, and then moves the second support means from the escape position to the support position thereby to align the rear end of the sheet bundle dropped onto the stack means.

On the other hand, another sheet handling apparatus according to the invention comprises: the intermediate handling means (e.g., the staple unit 510) for stacking and handling the sheets S conveyed from the sheet conveyance means (e.g., the body side discharge roller pair 207); the stack means (e.g., the stack tray 504) for stacking the sheet bundle handled by the intermediate handling means; the support means (e.g., the rear end aligning wall 570) capable of moving selectively to the support position for supporting the lower face of the sheet bundle handled by the intermediate handling means or the escape position escaped from the lower face of the sheet bundle; the change-over control means for changing the support position and the escape position of the support means; and the conveyance means (e.g., the rocking roller 550) capable of conveying the sheet bundle supported by the support means to the stack means. When the rear end of the sheet bundle is brought by conveyance means to reach the upper portion of the support means, the change-over control means makes controls to move the support means at the first moving velocity V1 to the escape position thereby to drop the sheet bundle onto the stack means, and then to move the support means at the second moving velocity V2 lower than the first moving velocity V1 from the escape position to the support position thereby to align the rear end of the sheet bundle dropped onto the stack means.

Here, the change-over control means may be exemplified either by such one as controls the movement of the rear end aligning wall or the support means between the support position and the escape position by detecting the movement of the sheet bundle with an electric sensor, or by such one as transmits the movement of the sheet bundle mechanically to the movement of the rear end aligning wall. Moreover, the change-over control means may be disposed in the sheet handling apparatus or in the control unit of the image forming apparatus.

(Sheet Returning Member)

The sheet returning member (as will be called the "paddle") 583 or a paddle-shaped member is turned on a paddle turning shaft 590 (referred to FIGS. 6A to 6C and FIGS. 7A to 7C) extended in the rear end aligning wall 570. The paddle 583 makes one turn each time the sheet bundle is discharged in its entirety onto the stack tray 504 by the rocking roller 550 with a counter clockwise rotation, so that it can pull back the discharged sheet bundle each time toward the rear end aligning wall 570 thereby to hold the rear end of the sheet bundle.

Here, the paddle 583 is kept in the state shown in FIG. 6A and FIG. 6B unless in the sheet returning action, thereby to hold the sheets S. The position of the paddle 583 at this time is detected with the not-shown paddle home position sensor 532.

On the other hand, the stack tray 504 is so constructed that it can be moved up and down by the not-shown drive means to keep the upper face of the stacked sheet bundle S at a constant height.

In this embodiment, the sheet stacking face of the stack tray 504 is set substantially horizontal. The aforementioned sheet rear end aligning means effectively acts, even in case the sheet stacking face is inclined, but is more effective in case the sheet stacking face is substantially horizontal. By setting the sheet stacking face 504*a* downward by 18 degrees or less toward the sheet rear end aligning wall, on the other hand, the apparatus can be small-sized while avoiding the interference between the rear end of the sheet bundle stacked on the stack tray 504 and the succeeding sheet bundle discharged from the handling tray 540.

(System Block Construction)

Figure 9:
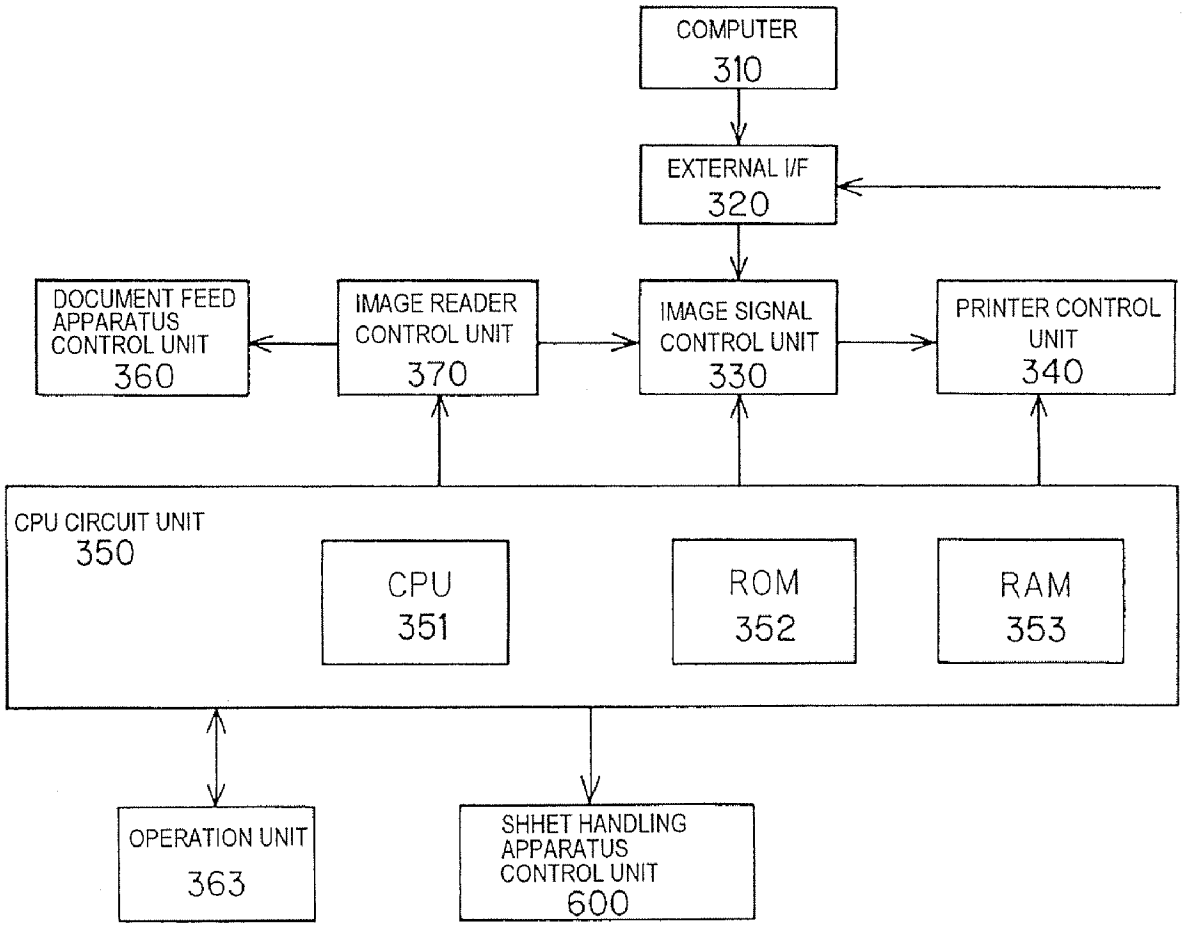
FIG. 9 is a block diagram showing a construction of a controller for controlling the image forming apparatus according to the embodiment.

Next, the construction of a controller for controlling the image forming apparatus as a whole will be described with reference to FIG. 9. FIG. 9 is a block diagram showing the construction of a controller for controlling the image forming apparatus according to the embodiment.

As shown in FIG. 9, the controller is provided with a CPU circuit unit 350, which has a CPU 351, a ROM 352 and a RAM 353 packaged therein. The CPU circuit unit 350 is so operated by the control programs stored in the ROM 352 as to control the individual blocks of an external I/F 320, an image signal control unit 330, a printer control unit 340, the RAM 353, a document feed device control unit 360, an image reader control unit 370 and the sheet handling apparatus control unit 600 generally.

The RAM 353 is used as a work area for holding the control data temporarily and for the operations accompanying the controls.

The document feed device control unit 360 drives and controls the document read device 100 on the basis of an instruction from the CPU circuit unit 350.

The image reader control unit 370 drives and controls the aforementioned scanner unit 104 and image sensor 109 and so on, and transfers an analog image signal outputted from the image sensor 109, to the image signal control unit 330.

The image signal control unit 330 transforms the analog image signal from the image sensor 109 into a digital signal and subjects the digital signal to individual processings. The image signal control unit 330 transforms the digital signal into a video signal and outputs the video signal to the printer control unit 340. Moreover, the image signal control unit 330 subjects a digital image signal inputted from a computer 310 through the external I/F 320, to various processings, and transforms the digital image signal into a video signal and outputs the video signal to the printer control unit 340. These processing actions by the image signal control unit 330 are controlled by the CPU circuit unit 350.

On the basis of the video signal inputted, the printer control unit 340 drives the aforementioned laser scanner unit 202.

An operation unit 363 is provided with a plurality of keys for setting the various functions relating to the image formation, and a display unit for displaying the information indicating the set state. The operation unit 363 outputs to the CPU circuit unit 350 a key signal corresponding to each key operation, and displays the corresponding information in the display unit on the basis of the signal from the CPU circuit unit 350.

The sheet handling apparatus control unit 600 is mounted on the sheet handling apparatus 500, and exchanges the information with the CPU circuit unit 350 to drive and control the sheet handling apparatus as a whole. These control contents will be described hereinafter.

(Sheet Handling Apparatus Block Diagram)

Next, the construction of the sheet handling apparatus control unit 600 for driving and controlling the sheet handling apparatus 500 will be described with reference to FIG. 8. FIG. 8 is a block diagram showing the construction of the sheet handling apparatus control unit according to the embodiment.

As shown in FIG. 8, the sheet handling apparatus control unit 600 is provided with a CPU circuit unit 610 including the CPU 611, a ROM 612 and a RAM 613. The CPU circuit unit 610 communicates for data exchanges with the CPU circuit unit 350 disposed on the side of the image forming apparatus body 200 through a communication IC 614, and executes the various programs stored in the ROM 612, on the basis of an instruction from the CPU circuit unit 350 thereby to drive and control the sheet handling apparatus 500.

Upon these drive controls, the CPU circuit unit 610 fetches detection signals from various sensors.

These various sensors are exemplified by an entrance sensor 521, a rocking home position sensor 522, the rear end aligning wall home position sensor 523, a tray detection sensor 524, a paper face detection sensor 525, a return belt escape sensor 526, a staple slide home position sensor 527 and a staple clinch home position sensor 528.

To the CPU circuit unit 610, there are connected the drivers 621 to 630 of the individual motors, which drive the motors on the basis of signals from the CPU circuit unit 610.

Here, the motors include: a discharge motor 641 acting as drive sources for an entrance conveyance roller pair 520 and the return belt 560; the rocking roller drive motor 642 for performing both the drive to return the sheets conveyed by the entrance transfer roller pair 520, with the rocking roller 550 attached to the leading end of the rocking arm 551, and the drive to discharge the sheet bundle handled on the handling tray 540 to the stack tray 504; the rocking arm drive motor 643 acting as a drive source for driving the rocking arm 551 in the vertical directions so as to catch the rear end portion of the sheets discharged to the handling tray 540; a rear end aligning wall drive motor 644 acting as a drive source for driving the rear end aligning wall 570 so as to align the rear end of the sheet bundle discharged onto the stack tray 504; a paddle motor 645 acting as a drive source for the paddle 583 or the holding member to hold the rear end portion of the sheet bundle stacked on the stack tray 504; the front aligning motor 646 and the rear aligning motor 647 acting as a drive source of the aligning plate for aligning the sheets stacked on the handling tray 540, perpendicularly of the sheet conveyance direction; the staple slide motor 649 acting as a drive source for driving the staple unit 510 in the longitudinal directions; the stack tray motor 650 acting as a drive source for the stack tray 504; and the staple clinch motor 648 acting as a drive source for the stapling actions of the staple unit 510.

The discharge motor 641, the rocking roller drive motor 642, the rocking arm drive motor 643, the rear end aligning wall drive motor 644, the paddle motor 645, the front aligning motor 646, the rear aligning motor 647 and the staple slide motor 649 are made of stepping motors, so that they are enabled to rotate the roller pairs driven by the individual motors, at constant velocities or at different velocities by controlling them at an excitation pulse rate.

On the other hand, the discharge motor 641, the rocking roller drive motor 642, the rocking arm drive motor 643, the front aligning motor 646, the rear aligning motor 647 and the staple slide motor 649 can be activated forward and backward the rotation direction by a discharge motor driver 621, the rocking roller drive motor driver 622, a rocking arm drive motor driver 623, a front aligning motor driver 626, a rear aligning motor driver 627 and a staple slide motor driver 629, respectively.

The staple clinch motor 648 and the stack tray motor 650 are made of DC motors.

According to the invention, as has been described hereinbefore, the sheets are stacked sequentially in alignment thereby to realize the retention of the load and the improvement in the productivity.

According to the invention, moreover, the sheet bundle can be prevented from becoming loose when it drops onto the stack means, thereby to stack the sheet bundle neatly in alignment on the stack means.

Moreover, the sheet bundle is stacked in the neatly aligned state so that its height can be precisely decided. As a result, the sheets are not stacked over their permissible number so that they can be prevented in advance from dropping from the stack means.

What is claimed is:

1. A sheet handling apparatus comprising:

a stack tray which stacks sheets or sheet bundles; and a pushing member which pushes a sheet or a sheet bundle to an alignment position on said stack tray, to align the sheet or the sheet bundle, wherein said pushing member moves to a standby position in a direction apart from said stack tray at a first moving velocity, and then moves toward the alignment position from the standby position at a second moving velocity which is slower than the first moving velocity.

2. A sheet handling apparatus according to claim 1, further comprising:

a conveyance portion which conveys the sheet or the sheet bundle toward said stack tray, wherein when the sheet or the sheet bundle is conveyed to the upper portion of said pushing member by said conveyance portion, said pushing member moves to the standby position.

3. A sheet handling apparatus according to claim 2, further comprising:

a handling tray which stacks a plurality of sheets temporarily to handle the sheet or the sheet bundle, disposed on the upstream side of said stack tray in the sheet conveyance direction of said conveyance portion, wherein said pushing member pushes the sheet bundle conveyed from said handling tray.

4. An image forming apparatus comprising:

an image forming means portion which forms an image on a sheet; and a sheet handling apparatus according to claim 1, which handles the image-formed sheet or sheet bundle.

5. An image forming apparatus comprising:

an image forming portion which forms an image on a sheet;

a stack tray which stacks the image-formed sheets or sheet bundles; and a pushing member which pushes a sheet or a sheet bundle to an alignment position on said stack tray, to align the sheet or the sheet bundle, wherein said pushing member moves to a standby position in a direction apart from said stack tray at a first moving velocity, and then moves toward the alignment position from the standby position at a second moving velocity which is slower than the first moving velocity.

* * * * *